US010249247B2

(12) United States Patent
Wang et al.

(10) Patent No.: US 10,249,247 B2
(45) Date of Patent: Apr. 2, 2019

(54) TRANSPARENT DUAL-SIDED DISPLAY DEVICE AND DRIVING METHOD THEREOF

(71) Applicant: Shenzhen China Star Optoelectronics Semiconductor Display Technology Co., Ltd., Shenzhen (CN)

(72) Inventors: Zhenling Wang, Shenzhen (CN); Taijiun Hwang, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/742,039

(22) PCT Filed: Dec. 4, 2017

(86) PCT No.: PCT/CN2017/114442

§ 371 (c)(1),
(2) Date: Jan. 5, 2018

(65) Prior Publication Data

US 2019/0066600 A1 Feb. 28, 2019

(30) Foreign Application Priority Data

Aug. 29, 2017 (CN) ..... 2017 1 0758266

(51) Int. Cl.
*G09G 3/3275* (2016.01)
*G09G 3/34* (2006.01)

(52) U.S. Cl.
CPC ..... *G09G 3/3275* (2013.01); *G09G 3/348* (2013.01); *G09G 2300/023* (2013.01); *G09G 2310/0297* (2013.01); *G09G 2310/08* (2013.01)

(58) Field of Classification Search
CPC ..... G06F 3/0412; G06F 3/042; G06F 3/03545
See application file for complete search history.

(56) References Cited

U.S. PATENT DOCUMENTS 6,310,592 B1 * 10/2001 Moon ..... G09G 3/3614 345/87
9,726,880 B1 8/2017 Novoselov et al.
(Continued)

FOREIGN PATENT DOCUMENTS

CN 202084275 U 12/2011
CN 105469765 A 4/2016
(Continued)

*Primary Examiner* — Shaheda A Abdin
(74) *Attorney, Agent, or Firm* — Leong C. Lei

(57) ABSTRACT

The present invention provides a transparent dual-sided display device and a driving method thereof. The transparent dual-sided display device includes a display panel including a plurality of sub-pixel groups that each include a front-side OLED sub-pixel, a back-side OLED sub-pixel, and an electrowetting sub-pixel and a plurality of multiplexer modules that each include three thin-film transistors and a timing controller is involved to control a multiplexer module and a source driver, wherein the source driver writes the front-side and back-side output data signals to the front-side OLED sub-pixel and the back-side OLED sub-pixel respectively and applies a reference voltage to the electrowetting sub-pixel, such that controlling can be, through the timing controller, a voltage controller to output a voltage value of the reference voltage to the source driver to control transparency or light-blocking of the electrowetting sub-pixel for simultaneously fulfilling transparent displaying and dual-sided displaying.

10 Claims, 6 Drawing Sheets

(56) References Cited

U.S. PATENT DOCUMENTS

| | | | | |
|---|---|---|---|---|
| 2008/0199667 | A1* | 8/2008 | Cho | G02F 1/091 428/212 |
| 2008/0266244 | A1* | 10/2008 | Bai | G09G 3/20 345/107 |
| 2009/0231662 | A1* | 9/2009 | Sorensson | G02F 1/15 359/273 |
| 2013/0100079 | A1* | 4/2013 | Chang | G06F 3/0412 345/175 |
| 2017/0206827 | A1 | 7/2017 | Koo et al. | |

FOREIGN PATENT DOCUMENTS

| | | | |
|---|---|---|---|
| CN | 106206665 | A | 12/2016 |
| CN | 107393474 | A | 11/2017 |

* cited by examiner

TRANSPARENT DUAL-SIDED DISPLAY DEVICE AND DRIVING METHOD THEREOF

BACKGROUND OF THE INVENTION

1. Field of the Invention

The present invention relates to the field of display technology, and more particular to a transparent dual-sided display device and a driving method thereof.

2. The Related Arts

Organic light-emitting display (OLED) possesses various advantages, such as being self-luminous, low drive voltage, high luminous efficiency, short response time, high clarity and contrast, almost 180° view angle, wide range of operation temperature, and easy realization of flexible displaying and large-area full-color displaying, and is considered the most promising display device in the industry.

Based on the way of driving, OLEDs can be classified in two categories, passive matrix OLED (PMOLED) and active matrix OLED (AMOLED), namely two categories of direct addressing and TFT array addressing, among which the AMOLED comprises pixels that are arranged in an array and belongs to an active display type, having high light emission performance and being commonly used in high definition large-sized display devices.

An OLED device is generally made up of a transparent substrate, an anode arranged on the transparent substrate, a hole injection layer arranged on and anode, a hole transport layer arranged on the hole injection layer, an emissive layer arranged on the hole transport layer, an electron transport layer arranged on the emissive layer, an electron injection layer arranged on the electron transport layer, and a cathode arranged on the electron injection layer. The principle of light emission of the OLED device is that when a semiconductor material and an organic light emission material are driven by an electric field, carrier currents are injected and re-combine to cause emission of light. Specifically, the OLED device often uses an indium tin oxide (ITO) electrode and a metal electrode to respectively serve as anode and cathode of the device and electrons and holes, when driven by a predetermined electrical voltage, are respectively injected into the electron transport layer and the hole transport layer from the cathode and the anode such that the electrons and the holes respectively migrate through the electron transport layer and the hole transport layer to get into the emissive layer and meet in the emissive layer to form excitons to excite light emissive molecules to emit light, the later undergoing radiation relaxation to give off visible light.

With the progress of the display technology, dual-sided display devices and transparent display devices are becoming hot spots of research for the major manufacturers. Referring to FIG. 1, a pixel arrangement of a known transparent display device is shown. The pixel arrangement comprises a plurality of pixels 100' arranged in an array. Each pixel 100' comprises a red sub-pixel 110', a green sub-pixel 120' and a blue sub-pixel 130' sequentially arranged. The red sub-pixel 110', the green sub-pixel 120' and the blue sub-pixel 130' each have a hollowed portion 140' in order to realize transparent displaying. Referring to FIG. 2, which shows a schematic view of a known dual-sided display device. The dual-sided display device comprises pixel 200" that are arranged in arrays on two sides of a transparent substrate 100" and corresponding to each other.

Each pixel 200" comprises a red sub-pixel 210", a green sub-pixel 220" and a blue sub-pixel 230" sequentially arranged. Dual displaying is achieved by separately driving the pixels 200" on the front side and rear side of the transparent substrate 100". The known display devices are only capable of one mode of either transparent displaying or dual-sided displaying and are incapable of providing both transparent displaying and dual-sided displaying.

Electrowetting (EW) is a phenomenon of wettability of a liquid drop on an insulating transparent substrate by varying an electric voltage between the liquid drop and the transparent substrate to change, so as to change contact angle to thus cause deformation and displacement of the liquid drop. Electrowetting technology has been used by some manufacturers to manufacture sub-pixels of display devices. Such an electrowetting sub-pixel, upon application of an electric voltage, would cause a change of a tension on a surface of the liquid in contact with outside of an electrode and consequently resulting in instability of a static condition, making the liquid transferred to a side to form a partly transparent pixel spot thereby achieving an effect of transparent displaying. Once the supply of electricity to the electrowetting sub-pixel is cut off, the liquid restores to the original position, allowing the electrowetting sub-pixel to display an effect of shieling light.

SUMMARY OF THE INVENTION

Objectives of the present invention are to provide a transparent dual-sided display device, which is capable of transparent displaying and dual-sided displaying.

Objectives of the present invention are also to provide a driving method of a transparent dual-sided display device capable of achieving both transparent displaying and dual-sided displaying at the same time.

To achieve the above objectives, firstly, the present invention provides a transparent dual-sided display device, which comprises a display panel, a source driver electrically connected to the display panel, a timing controller electrically connected to both the source driver and the display panel, and a voltage controller electrically connected to both the timing controller and the source driver;

wherein the display panel comprises a transparent substrate, a plurality of sub-pixel groups arranged in an array on the transparent substrate, and a plurality of multiplexer modules respectively corresponding to a plurality columns of the sub-pixel groups; the source driver comprises a plurality of output terminals respectively corresponding to the plurality of rows of sub-pixel groups; each of the sub-pixel groups comprises a front-side organic light emitting display (OLED) sub-pixel and a back-side OLED sub-pixel that are respectively arranged on two opposite sides of the transparent substrate and an electrowetting sub-pixel arranged on one of the sides of the transparent substrate; each of the multiplexer modules comprises a first thin-film transistor, a second thin-film transistor, and a third thin-film transistor, the first thin-film transistor having a gate electrode input with a first control signal, a drain electrode electrically connected to all the front-side OLED sub-pixels of the sub-pixel groups of one of the columns corresponding thereto, and a source electrode electrically connected to one of the output terminals of the source driver corresponding thereto, the second thin-film transistor having a gate electrode input with a second control signal, a drain electrode electrically connected to all the back-side OLED sub-pixels of the sub-pixel groups of the one of the columns corresponding thereto, and a source electrode electrically connected to the one of the output terminals of the source driver corresponding thereto, the third thin-film transistor having a gate electrode input with a third control signal, a drain electrode electrically connected to all the electrowetting sub-pixel of the sub-pixel groups of the one of the columns corresponding thereto, and a source electrode electrically connected to the one of the output terminals of the source driver corresponding thereto;

wherein the voltage controller comprises a fourth thin-film transistor and a fifth thin-film transistor, the fourth thin-film transistor having a gate electrode input with a fourth control signal, a source electrode input with a second voltage, and a drain electrode electrically connected to a drain electrode of the fifth thin-film transistor and outputting a reference voltage to the source driver, the fifth thin-film transistor having a gate electrode input with a fifth control signal and a source electrode input with a first voltage; the first voltage is greater than the second voltage; each of the electrowetting sub-pixels is transparent upon application of the first voltage and blocks light upon application of the second voltage; and wherein the timing controller is operable to receive an input data signal and generating and supplying a front-side output data signal and a back-side output data signal to the source driver, outputting the first, second, and third control signals to control the first, second, and third thin-film transistors to conduct on or cut off, outputting the fourth and fifth control signals to control a voltage value of the reference voltage output from the voltage controller, and outputting a source driving control signal to the source driver to control the source driver to output the front-side output data signal, the back-side output data signal, or the reference voltage.

The transparent dual-sided display device comprises a non-transparent dual-sided display mode and a transparent dual-sided display mode;

wherein when the transparent dual-sided display device is in the non-transparent dual-sided display mode, the timing controller outputs the fourth and fifth control signals to control the fourth thin-film transistor to conduct on and the fifth thin-film transistor cut off and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on; and when the transparent dual-sided display device is in the transparent dual-sided display mode, the timing controller outputs the fourth and fifth control signals to control the fourth thin-film transistor to cut off and the fifth thin-film transistor conducting on and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on.

When the transparent dual-sided display device is in the non-transparent dual-sided display mode or the transparent dual-sided display mode, the timing controller reads parts of the input data signal that correspond to each of the columns of the sub-pixel groups in a forward sequence in order to acquire an intermediate front-side output data signal and reads parts of the input data signal that correspond to each of the columns of the sub-pixel groups in a reversed sequence in order to acquire an intermediate back-side output data signal and then, proceeds with frequency doubling of the intermediate front-side output data signal and the intermediate back-side output data signal to thereby obtain, and also feed, the front-side output data signal and the back-side output data signal to the source driver.

The second voltage is a common voltage; and the transparent dual-sided display device further comprises a voltage generator module electrically connected to the source driver and the voltage controller and the voltage generator module is operable to supply an operation voltage to the source driver and supplying the first voltage and the common voltage to the voltage controller.

The timing controller comprises a data handling unit, a frequency multiplication processing unit electrically connected to the data handling unit, and a control signal generator unit;

the data handling unit is operable for reading the parts of the input data signal that correspond to each of the columns of the sub-pixel groups in the forward sequence to acquire the intermediate front-side output data signal and reading the parts of the input data signal that correspond to each of the columns of the sub-pixel groups in the reversed sequence to acquire the intermediate back-side output data signal;

the frequency multiplication processing unit is operable to carry out a frequency doubling operation on the intermediate front-side output data signal and the intermediate back-side output data signal to obtain the front-side output data signal and the back-side output data signal, respectively; and the control signal generator unit is operable to generate the first, second, third, fourth, and fifth control signals and the source driving control signal.

The present invention also provides a driving method of a transparent dual-sided display device, which comprises the following steps:

Step S1: providing a transparent dual-sided display device described above;

Step S2: entering a non-transparent dual-sided display mode, wherein the timing controller is input with the input data signal and outputs the fourth and fifth control signals to control the fourth thin-film transistor to conduct on and the fifth thin-film transistor cut off, and meanwhile, the timing controller outputs the first, second, and third control signals to conduct on the third thin-film transistor, the first thin-film transistor, and the second thin-film transistor in order and outputs the front-side output data signal, the back-side output data signal, and the source driving control signal to the source driver to allow the source driver to apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on; and Step S3: entering a transparent dual-sided display mode, wherein the timing controller is input with the input data signal and outputs the fourth and fifth control signals to control the fourth thin-film transistor to cut off and the fifth thin-film transistor conducting one, and meanwhile, the timing controller outputs the first, second, and third control signals to conduct on the third thin-film transistor, the first thin-film transistor, the second thin-film transistor in order and outputs the front-side output data signal, the back-side output data signal, and the source driving control signal to the source driver to allow the source driver to apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on.

In Steps S2 and S3, the timing controller reads parts of the input data signal that correspond to each of the columns of the sub-pixel groups in a forward sequence in order to acquire intermediate front-side output data signal and reads parts of the input data signal that correspond to each of the columns of the sub-pixel groups in a reversed sequence in order to acquire intermediate back-side output data signal and then, proceeds with frequency doubling of the intermediate front-side output data signal and the intermediate back-side output data signal to thereby obtain, and also feed, the front-side output data signal and the back-side output data signal to the source driver.

The second voltage is a common voltage; and the transparent dual-sided display device further comprises a voltage generator module electrically connected to the source driver and the voltage controller and the voltage generator module is operable to supply an operation voltage to the source driver and supplying the first voltage and the common voltage to the voltage controller.

The timing controller comprises a data handling unit, a frequency multiplication processing unit electrically connected to the data handling unit, and a control signal generator unit; and in Steps S2 and S3, the data handling unit reads the parts of the input data signal that correspond to each of the columns of the sub-pixel groups in the forward sequence to acquire the intermediate front-side output data signal and reading the parts of the input data signal that correspond each of the columns of the sub-pixel groups in the reversed sequence to acquire the intermediate back-side output data signal; the frequency multiplication processing unit carries out a frequency doubling operation on the intermediate front-side output data signal and the intermediate back-side output data signal to obtain the front-side output data signal and the back-side output data signal, respectively;

the control signal generator unit generates the first, second, third, fourth, and fifth control signals and the source driving control signal.

The present invention further provides a transparent dual-sided display device, which comprises a display panel, a source driver electrically connected to the display panel, a timing controller electrically connected to both the source driver and the display panel, and a voltage controller electrically connected to both the timing controller and the source driver;

wherein the display panel comprises a transparent substrate, a plurality of sub-pixel groups arranged in an array on the transparent substrate, and a plurality of multiplexer modules respectively corresponding to a plurality columns of the sub-pixel groups; the source driver comprises a plurality of output terminals respectively corresponding to the plurality of rows of sub-pixel groups; each of the sub-pixel groups comprises a front-side organic light emitting display (OLED) sub-pixel and a back-side OLED sub-pixel that are respectively arranged on two opposite sides of the transparent substrate and an electrowetting sub-pixel arranged on one of the sides of the transparent substrate; each of the multiplexer modules comprises a first thin-film transistor, a second thin-film transistor, and a third thin-film transistor, the first thin-film transistor having a gate electrode input with a first control signal, a drain electrode electrically connected to all the front-side OLED sub-pixels of the sub-pixel groups of one of the columns corresponding thereto, and a source electrode electrically connected to one of the output terminals of the source driver corresponding thereto, the second thin-film transistor having a gate electrode input with a second control signal, a drain electrode electrically connected to all the back-side OLED sub-pixels of the sub-pixel groups of the one of the columns corresponding thereto, and a source electrode electrically connected to the one of the output terminals of the source driver corresponding thereto, the third thin-film transistor having a gate electrode input with a third control signal, a drain electrode electrically connected to all the electrowetting sub-pixel of the sub-pixel groups of the one of the columns corresponding thereto, and a source electrode electrically connected to the one of the output terminals of the source driver corresponding thereto;

wherein the voltage controller comprises a fourth thin-film transistor and a fifth thin-film transistor, the fourth thin-film transistor having a gate electrode input with a fourth control signal, a source electrode input with a second voltage, and a drain electrode electrically connected to a drain electrode of the fifth thin-film transistor and outputting a reference voltage to the source driver, the fifth thin-film transistor having a gate electrode input with a fifth control signal and a source electrode input with a first voltage; the first voltage is greater than the second voltage; each of the electrowetting sub-pixels is transparent upon application of the first voltage and blocks light upon application of the second voltage;

wherein the timing controller is operable to receive an input data signal and generating and supplying a front-side output data signal and a back-side output data signal to the source driver, outputting the first, second, and third control signals to control the first, second, and third thin-film transistors to conduct on or cut off, outputting the fourth and fifth control signals to control a voltage value of the reference voltage output from the voltage controller, and outputting a source driving control signal to the source driver to control the source driver to output the front-side output data signal, the back-side output data signal, or the reference voltage;

wherein the transparent dual-sided display device comprises a non-transparent dual-sided display mode and a transparent dual-sided display mode;

wherein when the transparent dual-sided display device is in the non-transparent dual-sided display mode, the timing controller outputs the fourth and fifth control signals to control the fourth thin-film transistor to conduct on and the fifth thin-film transistor cut off and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on; and when the transparent dual-sided display device is in the transparent dual-sided display mode, the timing controller outputs the fourth and fifth control signals to control the fourth thin-film transistor to cut off and the fifth thin-film transistor conducting on and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on;

wherein when the transparent dual-sided display device is in the non-transparent dual-sided display mode or the transparent dual-sided display mode, the timing controller reads parts of the input data signal that correspond to each of the columns of the sub-pixel groups in a forward sequence in order to acquire an intermediate front-side output data signal and reads parts of the input data signal that correspond to each of the columns of the sub-pixel groups in a reversed sequence in order to acquire an intermediate back-side output data signal and then, proceeds with frequency doubling of the intermediate front-side output data signal and the intermediate back-side output data signal to thereby obtain, and also feed, the front-side output data signal and the back-side output data signal to the source driver;

wherein the second voltage is a common voltage; and the transparent dual-sided display device further comprises a voltage generator module electrically connected to the source driver and the voltage controller and the voltage generator module is operable to supply an operation voltage to the source driver and supplying the first voltage and the common voltage to the voltage controller; and wherein the timing controller comprises a data handling unit, a frequency multiplication processing unit electrically connected to the data handling unit, and a control signal generator unit;

the data handling unit is operable for reading the parts of the input data signal that correspond to each of the columns of the sub-pixel groups in the forward sequence to acquire the intermediate front-side output data signal and reading the parts of the input data signal that correspond to each of the columns of the sub-pixel groups in the reversed sequence to acquire the intermediate back-side output data signal;

the frequency multiplication processing unit is operable to carry out a frequency doubling operation on the intermediate front-side output data signal and the intermediate back-side output data signal to obtain the front-side output data signal and the back-side output data signal, respectively; and the control signal generator unit is operable to generate the first, second, third, fourth, and fifth control signals and the source driving control signal.

The efficacy of the present invention is that the present invention provides a transparent dual-sided display device. The transparent dual-sided display device comprises a display panel comprising a plurality of sub-pixel groups that each include a front-side OLED sub-pixel, a back-side OLED sub-pixel, and an electrowetting sub-pixel and a plurality of multiplexer modules that each include three thin-film transistors and a timing controller is involved to control a multiplexer module and a source driver, wherein the source driver writes the front-side and back-side output data signals to the front-side OLED sub-pixel and the back-side OLED sub-pixel respectively and applies a reference voltage to the electrowetting sub-pixel, such that controlling can be, through the timing controller, a voltage controller to output a voltage value of the reference voltage to the source driver to control transparency or light-blocking of the electrowetting sub-pixel for simultaneously fulfilling transparent displaying and dual-sided displaying. The present invention provides a driving method of the transparent dual-sided display device, which allows for simultaneously fulfilling transparent displaying and dual-sided displaying.

BRIEF DESCRIPTION OF THE DRAWINGS

For better understanding of the features and technical contents of the present invention, reference will be made to the following detailed description of the present invention and the attached drawings. However, the drawings are provided only for reference and illustration and are not intended to limit the present invention.

In the drawings.

DETAILED DESCRIPTION OF THE PREFERRED EMBODIMENTS

To further expound the technical solution adopted in the present invention and the advantages thereof, a detailed description will be given with reference to the preferred embodiments of the present invention and the drawings thereof.

Figure 1:
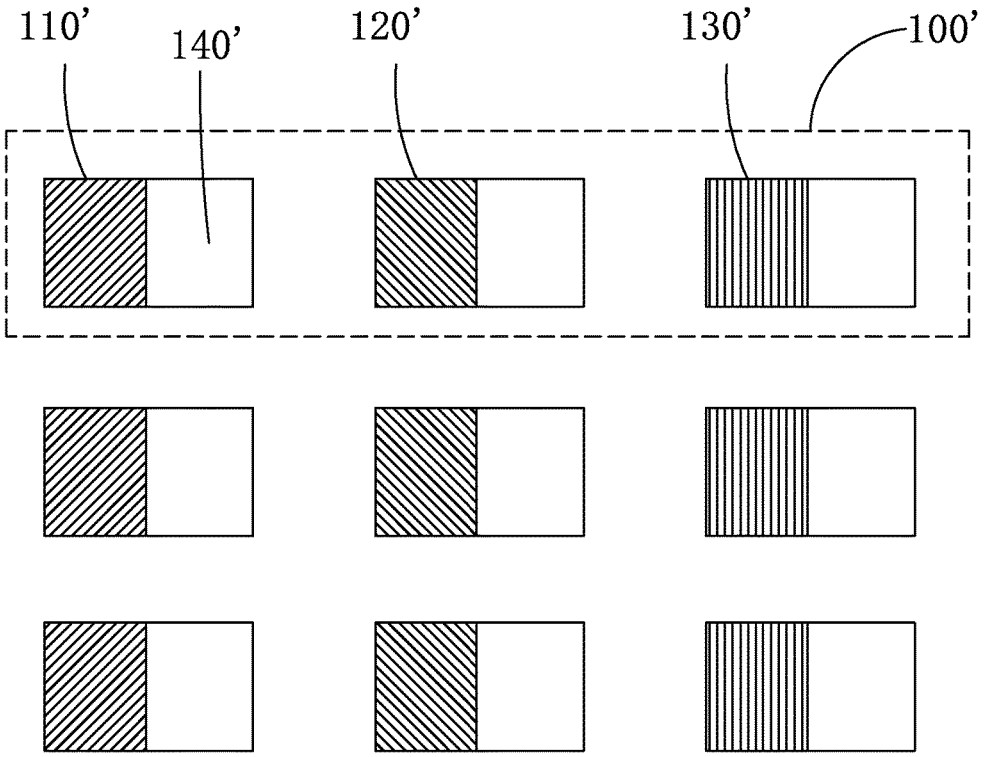
FIG. 1 is a schematic view illustrating a pixel structure of a known transparent display device.
Figure 2:
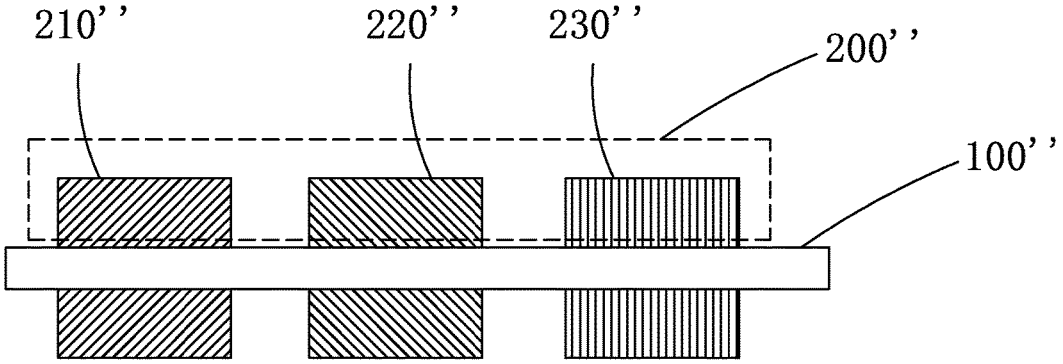
FIG. 2 is a schematic view illustrating a structure of a known dual-sided display device.
Figure 3:
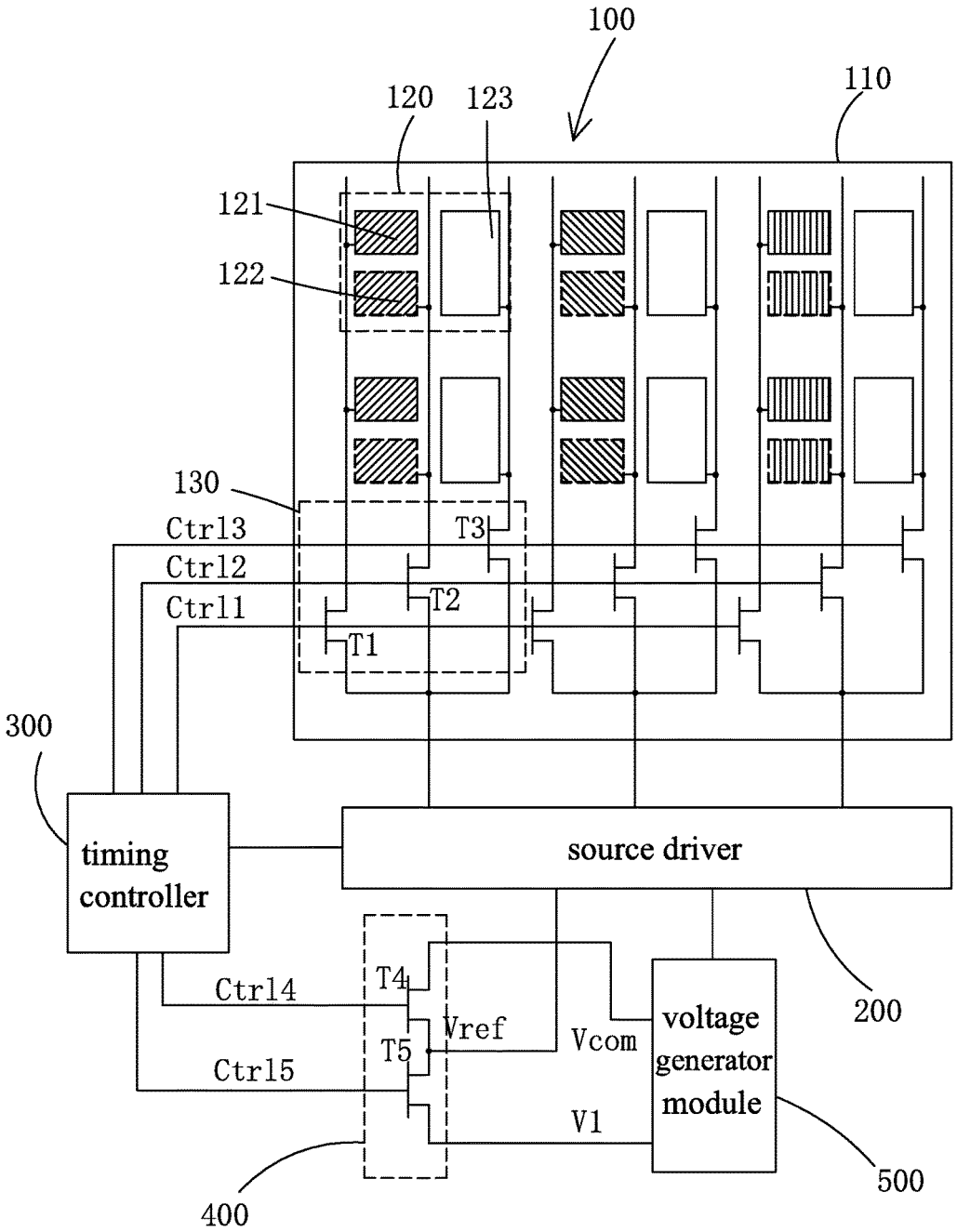
FIG. 3 is a schematic view illustrating a structure of a transparent dual-sided display device according to the present invention.
Figure 4:
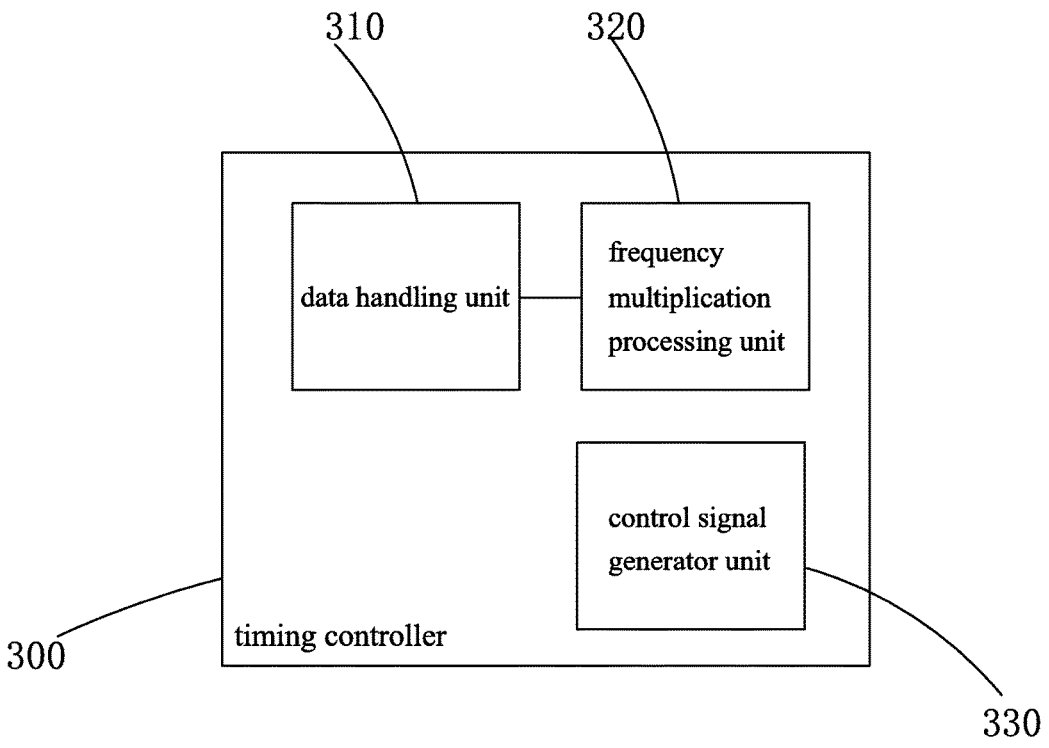
FIG. 4 is a block diagram of a timing controller of the transparent dual-sided display device according to the present invention.
Figure 6:
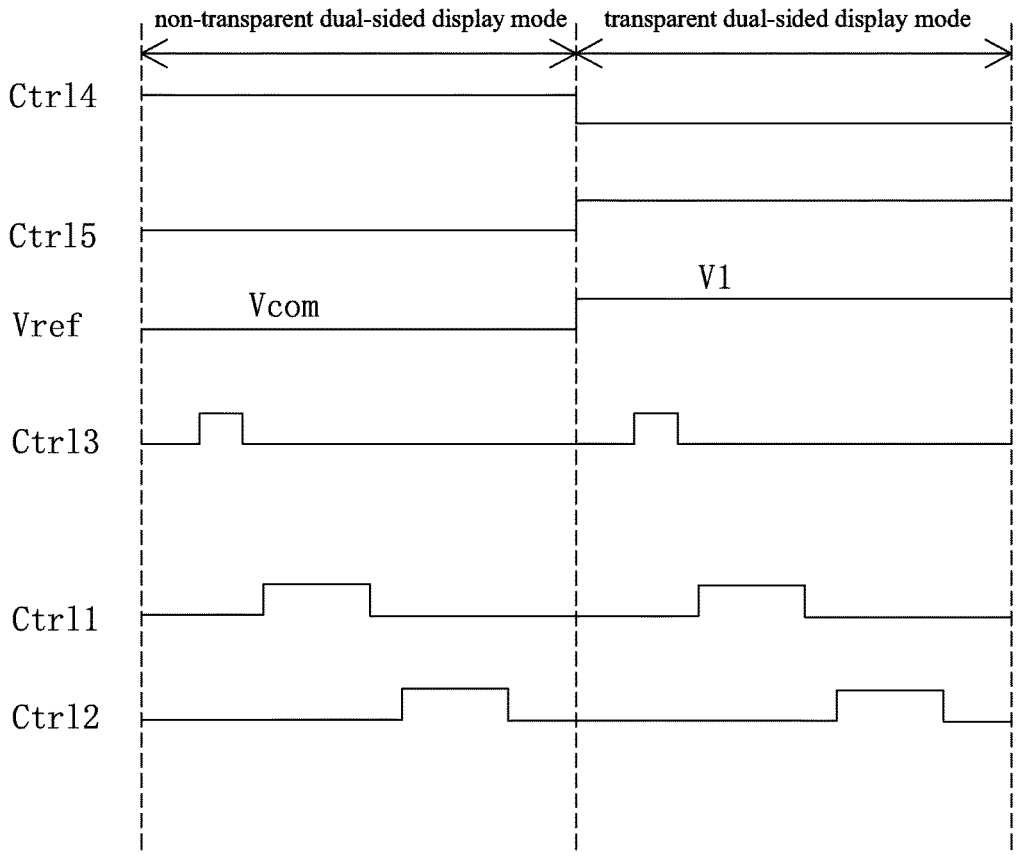
FIG. 6 is a timing diagram of the driving method of the transparent dual-sided display device according to the present invention.

Referring to FIGS. 3 and 4, in combination with FIG. 6, the present invention provides a transparent dual-sided display device, which comprises a display panel 100, a source driver 200 electrically connected to the display panel 100, a timing controller 300 electrically connected to both the source driver 200 and the display panel 100, and a voltage controller 400 electrically connected to both the timing controller 300 and the source driver 200.

The display panel 100 comprises a transparent substrate 110, a plurality of sub-pixel groups 120 arranged in an array on the transparent substrate 110, and a plurality of multiplexer modules 130 respectively corresponding to a plurality columns of the sub-pixel groups 120. The source driver 200 comprises a plurality of output terminals respectively corresponding to the plurality of rows of sub-pixel groups 120. Each of the sub-pixel groups 120 comprises a front-side OLED sub-pixel 121 and a back-side organic light emitting display (OLED) sub-pixel 122 that are respectively arranged on two opposite sides of the transparent substrate 110 and an electrowetting sub-pixel 123 arranged on one of the sides of the transparent substrate 110. Each of the multiplexer modules 130 comprises a first thin-film transistor T1, a second thin-film transistor T2, and a third thin-film transistor T3. The first thin-film transistor T1 has a gate electrode input with a first control signal Ctrl1, a drain electrode electrically connected to all the front-side OLED sub-pixels 121 of the sub-pixel groups 120 of one of the columns corresponding thereto, and a source electrode electrically connected to one of the output terminals of the source driver 200 corresponding thereto. The second thin-film transistor T2 has a gate electrode input with a second control signal Ctrl2, a drain electrode electrically connected to all the back-side OLED sub-pixels 122 of the sub-pixel groups 120 of the one of the columns corresponding thereto, and a source electrode electrically connected to the one of the output terminals of the source driver 200 corresponding thereto. The third thin-film transistor T3 has a gate electrode input with a third control signal Ctrl3, a drain electrode electrically connected to all the electrowetting sub-pixel 123 of the sub-pixel groups 120 of the one of the columns corresponding thereto, and a source electrode electrically connected to the one of the output terminals of the source driver 200 corresponding thereto.

The voltage controller 400 comprises a fourth thin-film transistor T4 and a fifth thin-film transistor T5. The fourth thin-film transistor T4 has a gate electrode input with a fourth control signal Ctrl4, a source electrode input with a second voltage, and a drain electrode electrically connected to a drain electrode of the fifth thin-film transistor T5 and outputting a reference voltage Vref to the source driver 200. The fifth thin-film transistor T5 has a gate electrode input with a fifth control signal Ctrl5 and a source electrode input with a first voltage V1. The first voltage V1 is greater than the second voltage. Each of the electrowetting sub-pixels 123 is transparent upon application of the first voltage V1 and blocks light upon application of the second voltage.

The timing controller 300 functions to receive an input data signal and generating and supplying a front-side output data signal and a back-side output data signal to the source driver 200, outputting the first, second, and third control signals Ctrl1, Ctrl2, Ctrl3 to control the first, second, and third thin-film transistors T1, T2, T3 to conduct on or cut off, outputting the fourth and fifth control signals Ctrl4, Ctrl5 to control a voltage value of the reference voltage Vref output from the voltage controller 400, and outputting a source driving control signal to the source driver 200 to control the source driver 200 to output the front-side output data signal, the back-side output data signal, or the reference voltage Vref.

Specifically, the second voltage is a common voltage Vcom.

Specifically, the transparent dual-sided display device further comprises a voltage generator module 500 electrically connected to the source driver 200 and the voltage controller 400. The voltage generator module 500 is operable to supply an operation voltage to the source driver 200 and supplying the first voltage V1 and the common voltage Vcom to the voltage controller 400.

Specifically, referring to FIG. 6, the transparent dual-sided display device has a non-transparent dual-sided display mode and a transparent dual-sided display mode.

When the transparent dual-sided display device is in the non-transparent dual-sided display mode, the timing controller 300 outputs the fourth control signal Ctrl4 at a high level and the fifth control signal Ctrl5 at a low level to make the fourth thin-film transistor T4 conducting on and the fifth thin-film transistor T5 cut off and under this condition, the reference voltage Vref supplied from the voltage controller 400 to the source driver 200 is the common voltage Vcom and meanwhile, the timing controller 300 outputs the first, second, and third control signals Ctrl1, Ctrl2, Ctrl3, and the first, second, and third control signals Ctrl1, Ctrl2, Ctrl3 each comprise a high level pulse, wherein the high level pulse of the third control signal Ctrl3 is earlier than the high level pulse of the first control signal Ctrl1 and the high level pulse of the first control signal Ctrl1 is earlier than the high level pulse of the second control signal Ctrl2 so as to conduct on the third thin-film transistor T3, the first thin-film transistor T1, and the second thin-film transistor T2 in order; and further, the timing controller 300 converts the input data signal input thereto into the front-side output data signal and the back-side output data signal to be output to the source driver 200 and also outputs a source driving control signal to the source driver 200 to make the source driver 200 apply the reference voltage Vref to the electrowetting sub-pixel 123 when the third thin-film transistor T3 is conducting on, output the front-side output data signal to the front-side OLED sub-pixel 121 when the first thin-film transistor T1 is conducting on, and output the back-side output data signal to the back-side OLED sub-pixel 12 when the second thin-film transistor T2 is conducting on. Since under this condition, the reference voltage Vref is the common voltage Vcom, the electrowetting sub-pixel 123 is in a light-blocking state and the front-side OLED sub-pixel 121 and the back-side OLED sub-pixel 122 are respectively driven by the front-side output data signal and the back-side output data signal so that the transparent dual-sided display device carries out non-transparent dual-sided displaying.

When the transparent dual-sided display device in the transparent dual-sided display mode, the timing controller 300 outputs the fourth control signal Ctrl4 at a low level and the fifth control signal Ctrl5 at a high level to make the fourth thin-film transistor T4 cut off and the fifth thin-film transistor T5 conducting on and under this condition, the reference voltage Vref supplied from the voltage controller 400 to the source driver 200 is the first voltage V1 and meanwhile, the timing controller 300 outputs the first, second, and third control signals Ctrl1, Ctrl2, Ctrl3, and the first, second, and third control signals Ctrl1, Ctrl2, Ctrl3 each comprise a high level pulse, wherein the high level pulse of the third control signal Ctrl3 is earlier than the high level pulse of the first control signal Ctrl1 and the high level pulse of the first control signal Ctrl1 is earlier than the high level pulse of the second control signal Ctrl2 so as to conduct on the third thin-film transistor T3, the first thin-film transistor T1, and the second thin-film transistor T2 in order; and further, the timing controller 300 converts the input data signal input thereto into the front-side output data signal and the back-side output data signal to be output to the source driver 200 and also outputs a source driving control signal to the source driver 200 to make the source driver 200 apply the reference voltage Vref to the electrowetting sub-pixel 123 when the third thin-film transistor T3 is conducting on, output the front-side output data signal to the front-side OLED sub-pixel 121 when the first thin-film transistor T1 is conducting on, and output the back-side output data signal to the back-side OLED sub-pixel 12 when the second thin-film transistor T2 is conducting on. Since under this condition, the reference voltage Vref is the first voltage V1, the electrowetting sub-pixel 123 is in a transparent state and the front-side OLED sub-pixel 121 and the back-side OLED sub-pixel 122 are respectively driven by the front-side output data signal and the back-side output data signal so that the transparent dual-sided display device carries out transparent dual-sided displaying.

Specifically, when the transparent dual-sided display device is in the non-transparent dual-sided display mode or the transparent dual-sided display mode, the timing controller 300 reads parts of the input data signal that correspond to each of the columns of the sub-pixel groups 120 in a forward sequence in order to acquire an intermediate front-side output data signal and reads parts of the input data signal that correspond to each of the columns of the sub-pixel groups 120 in a reversed sequence in order to acquire an intermediate back-side output data signal and then, proceeds with frequency doubling of the intermediate front-side output data signal and the intermediate back-side output data signal to thereby obtain, and also feed, the front-side output data signal and the back-side output data signal to the source driver 200.

Further, referring to FIG. 4, the timing controller 300 comprises a data handling unit 310, a frequency multiplication processing unit 320 electrically connected to the data handling unit 310, and a control signal generator unit 330. The data handling unit 310 is operable for reading the parts of the input data signal that correspond to each of the columns of the sub-pixel groups 120 in the forward sequence to acquire the intermediate front-side output data signal and reading the parts of the input data signal that correspond to each of the columns of the sub-pixel groups 120 in the reversed sequence to acquire the intermediate back-side output data signal. The frequency multiplication processing unit 320 is operable to carry out a frequency doubling operation on the intermediate front-side output data signal and the intermediate back-side output data signal to obtain the front-side output data signal and the back-side output data signal, respectively. The control signal generator unit 330 is operable to generate the first, second, third, fourth, and fifth control signals Ctrl1, Ctrl2, Ctrl3, Ctrl4, Ctrl5 and the source driving control signal.

It is noted that the transparent dual-sided display device of the present invention, which includes a display panel 100 comprising a plurality of sub-pixel groups 120 that each include a front-side OLED sub-pixel 121, a back-side OLED sub-pixel 122, and an electrowetting sub-pixel 123 and a plurality of multiplexer modules 130 that each include three thin-film transistors, such that the OLED sub-pixels and the electrowetting sub-pixels can be all manufactured with a printing process so that the manufacturing of the transparent dual-sided display device of the present invention is made easy and in addition, the present invention involves a timing controller 300 to control the multiplexer modules 130 and the source driver 200 such that the source driver 200 writes the front-side and the back-side output data signals to the front-side OLED sub-pixel 121 and the back-side OLED sub-pixel 122 respectively and apply the reference voltage Vref to the electrowetting sub-pixel 123 to thereby effectively reduces the number of output terminals of the source driver 200, while using the timing controller 300 to control the voltage controller 400 for outputting the voltage value of the reference voltage Vref to the source driver 200 to realize controlling transparency or light-blocking of the electrowetting sub-pixel 123 for simultaneously fulfilling transparent displaying and dual-sided displaying.

Figure 5:
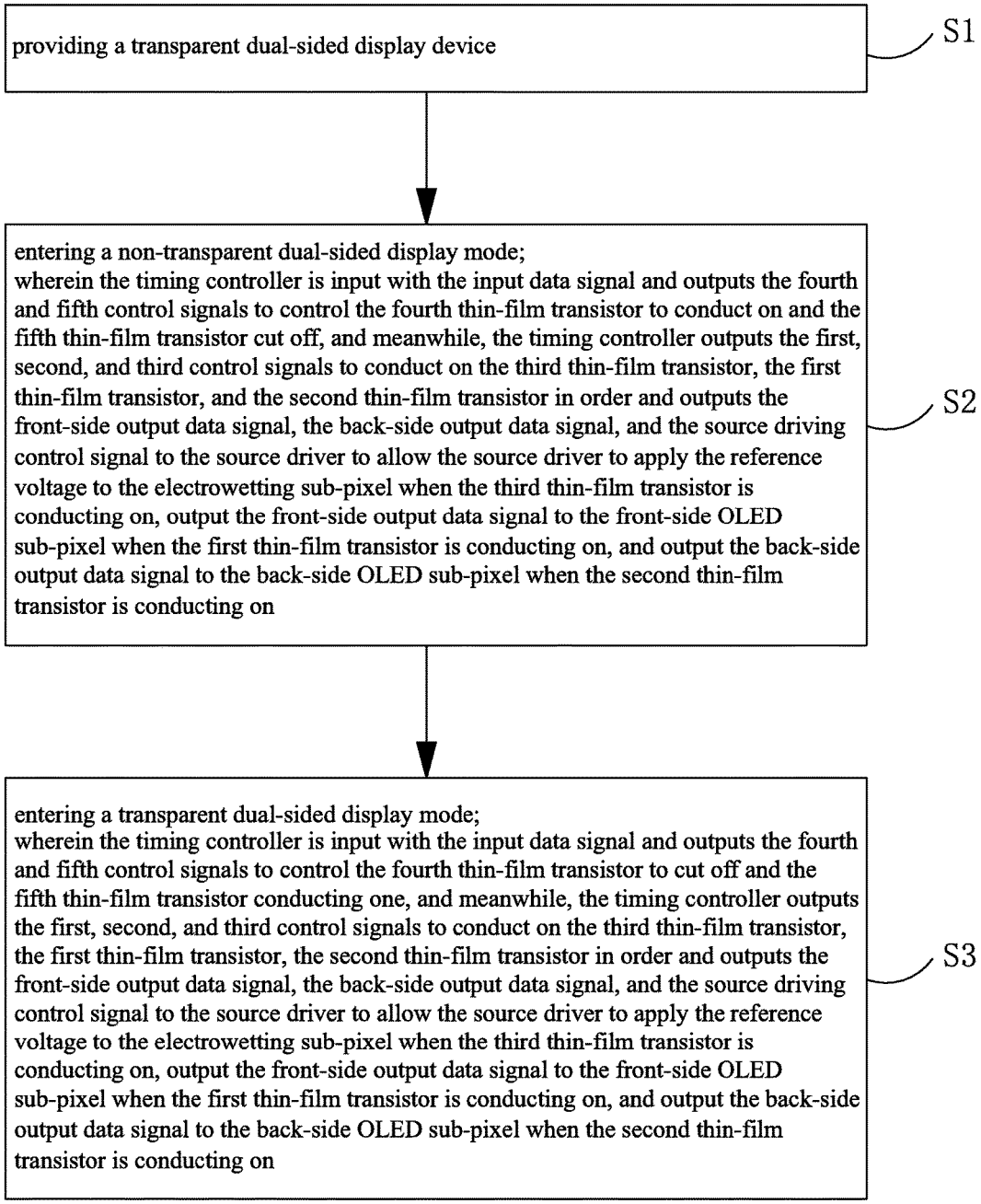
FIG. 5 is a flow chart illustrating a driving method of the transparent dual-sided display device according to the present invention.

Referring to FIG. 5, based on the same inventive idea, the present invention also provides a driving method of a transparent dual-sided display device, which comprises the following steps:

Step S1: referring to FIG. 3, providing a transparent dual-sided display device, wherein the transparent dual-sided display device comprises a display panel 100, a source driver 200 electrically connected to the display panel 100, a timing controller 300 electrically connected to both the source driver 200 and the display panel 100, and a voltage controller 400 electrically connected to both the timing controller 300 and the source driver 200.

The display panel 100 comprises a transparent substrate 110, a plurality of sub-pixel groups 120 arranged in an array on the transparent substrate 110, and a plurality of multiplexer modules 130 respectively corresponding to a plurality columns of the sub-pixel groups 120. The source driver 200 comprises a plurality of output terminals respectively corresponding to the plurality of rows of sub-pixel groups 120. Each of the sub-pixel groups 120 comprises a front-side OLED sub-pixel 121 and a back-side OLED sub-pixel 122 that are respectively arranged on two opposite sides of the transparent substrate 110 and an electrowetting sub-pixel 123 arranged on one of the sides of the transparent substrate 110. Each of the multiplexer modules 130 comprises a first thin-film transistor T1, a second thin-film transistor T2, and a third thin-film transistor T3. The first thin-film transistor T1 has a gate electrode input with a first control signal Ctrl1, a drain electrode electrically connected to all the front-side OLED sub-pixels 121 of the sub-pixel groups 120 of one of the columns corresponding thereto, and a source electrode electrically connected to one of the output terminals of the source driver 200 corresponding thereto. The second thin-film transistor T2 has a gate electrode input with a second control signal Ctrl2, a drain electrode electrically connected to all the back-side OLED sub-pixels 122 of the sub-pixel groups 120 of the one of the columns corresponding thereto, and a source electrode electrically connected to the one of the output terminals of the source driver 200 corresponding thereto. The third thin-film transistor T3 has a gate electrode input with a third control signal Ctrl3, a drain electrode electrically connected to all the electrowetting sub-pixel 123 of the sub-pixel groups 120 of the one of the columns corresponding thereto, and a source electrode electrically connected to the one of the output terminals of the source driver 200 corresponding thereto.

The voltage controller 400 comprises a fourth thin-film transistor T4 and a fifth thin-film transistor T5. The fourth thin-film transistor T4 has a gate electrode input with a fourth control signal Ctrl4, a source electrode input with a second voltage, and a drain electrode electrically connected to a drain electrode of the fifth thin-film transistor T5 and outputting a reference voltage Vref to the source driver 200. The fifth thin-film transistor T5 has a gate electrode input with a fifth control signal Ctrl5 and a source electrode input with a first voltage V1. The first voltage V1 is greater than the second voltage. Each of the electrowetting sub-pixels 123 is transparent upon application of the first voltage V1 and blocks light upon application of the second voltage.

The first, second, third, fourth, and fifth control signals Ctrl1, Ctrl2, Ctrl3, Ctrl4, Ctrl5 are supplied from the timing controller 200.

Specifically, the second voltage is a common voltage Vcom.

Specifically, the transparent dual-sided display device further comprises a voltage generator module 500 electrically connected to the source driver 200 and the voltage controller 400. The voltage generator module 500 is operable to supply an operation voltage to the source driver 200 and supplies the first voltage V1 and the common voltage Vcom to the voltage controller 400.

Step S2: referring to FIG. 6, entering a non-transparent dual-sided display mode, wherein timing controller 300 outputs the fourth control signal Ctrl4 at a high level and the fifth control signal Ctrl5 at a low level to make the fourth thin-film transistor T4 conducting on and the fifth thin-film transistor T5 cut off and under this condition, the reference voltage Vref supplied from the voltage controller 400 to the source driver 200 is the common voltage Vcom and meanwhile, the timing controller 300 outputs the first, second, and third control signals Ctrl1, Ctrl2, Ctrl3, and the first, second, and third control signals Ctrl1, Ctrl2, Ctrl3 each comprise a high level pulse, wherein the high level pulse of the third control signal Ctrl3 is earlier than the high level pulse of the first control signal Ctrl1 and the high level pulse of the first control signal Ctrl1 is earlier than the high level pulse of the second control signal Ctrl2 so as to conduct on the third thin-film transistor T3, the first thin-film transistor T1, and the second thin-film transistor T2 in order; and further, the timing controller 300 converts the input data signal input thereto into the front-side output data signal and the back-side output data signal to be output to the source driver 200 and also outputs a source driving control signal to the source driver 200 to make the source driver 200 apply the reference voltage Vref to the electrowetting sub-pixel 123 when the third thin-film transistor T3 is conducting on, output the front-side output data signal to the front-side OLED sub-pixel 121 when the first thin-film transistor T1 is conducting on, and output the back-side output data signal to the back-side OLED sub-pixel 12 when the second thin-film transistor T2 is conducting on. Since under this condition, the reference voltage Vref is the common voltage Vcom, the electrowetting sub-pixel 123 is in a light-blocking state and the front-side OLED sub-pixel 121 and the back-side OLED sub-pixel 122 are respectively driven by the front-side output data signal and the back-side output data signal so that the transparent dual-sided display device carries out non-transparent dual-sided displaying.

Step S3: referring to FIG. 6, entering the transparent dual-sided display mode, wherein the timing controller 300 outputs the fourth control signal Ctrl4 at a low level and the fifth control signal Ctrl5 at a high level to make the fourth thin-film transistor T4 cut off and the fifth thin-film transistor T5 conducting on and under this condition, the reference voltage Vref supplied from the voltage controller 400 to the source driver 200 is the first voltage V1 and meanwhile, the timing controller 300 outputs the first, second, and third control signals Ctrl1, Ctrl2, Ctrl3, and the first, second, and third control signals Ctrl1, Ctrl2, Ctrl3 each comprise a high level pulse, wherein the high level pulse of the third control signal Ctrl3 is earlier than the high level pulse of the first control signal Ctrl1 and the high level pulse of the first control signal Ctrl1 is earlier than the high level pulse of the second control signal Ctrl2 so as to conduct on the third thin-film transistor T3, the first thin-film transistor T1, and the second thin-film transistor T2 in order; and further, the timing controller 300 converts the input data signal input thereto into the front-side output data signal and the back-side output data signal to be output to the source driver 200 and also outputs a source driving control signal to the source driver 200 to make the source driver 200 apply the reference voltage Vref to the electrowetting sub-pixel 123 when the third thin-film transistor T3 is conducting on, output the front-side output data signal to the front-side OLED sub-pixel 121 when the first thin-film transistor T1 is conducting on, and output the back-side output data signal to the back-side OLED sub-pixel 12 when the second thin-film transistor T2 is conducting on. Since under this condition, the reference voltage Vref is the first voltage V1, the electrowetting sub-pixel 123 is in a transparent state and the front-side OLED sub-pixel 121 and the back-side OLED sub-pixel 122 are respectively driven by the front-side output data signal and the back-side output data signal so that the transparent dual-sided display device carries out transparent dual-sided displaying.

Specifically, in Steps S2 and S3, the timing controller 300 reads parts of the input data signal that correspond to each of the columns of the sub-pixel groups 120 in a forward sequence in order to acquire intermediate front-side output data signal and reads parts of the input data signal that correspond to each of the columns of the sub-pixel groups 120 in a reversed sequence in order to acquire intermediate back-side output data signal and then, proceeds with frequency doubling of the intermediate front-side output data signal and the intermediate back-side output data signal to thereby obtain, and also feed, the front-side output data signal and the back-side output data signal to the source driver 200.

Specifically, the timing controller 300 comprises a data handling unit 310, a frequency multiplication processing unit 320 electrically connected to the data handling unit 310, and a control signal generator unit 330.

Further, in Steps S2 and S3, the data handling unit 310 reads the parts of the input data signal that correspond to each of the columns of the sub-pixel groups 120 in the forward sequence to acquire the intermediate front-side output data signal and reading the parts of the input data signal that correspond each of the columns of the sub-pixel groups 120 in the reversed sequence to acquire the intermediate back-side output data signal. The frequency multiplication processing unit 320 carries out a frequency doubling operation on the intermediate front-side output data signal and the intermediate back-side output data signal to obtain the front-side output data signal and the back-side output data signal, respectively. The control signal generator unit 330 generates the first, second, third, fourth, and fifth control signals Ctrl1, Ctrl2, Ctrl3, Ctrl4, Ctrl5 and the source driving control signal.

It is noted that the driving method of the transparent dual-sided display device of the present invention is such that the transparent dual-sided display device so provided comprises a display panel 100 comprising a plurality of sub-pixel groups 120 that each include a front-side OLED sub-pixel 121, a back-side OLED sub-pixel 122, and an electrowetting sub-pixel 123 and a plurality of multiplexer modules 130 that each include three thin-film transistors, such that the OLED sub-pixels and the electrowetting sub-pixels can be all manufactured with a printing process so that the manufacturing of the transparent dual-sided display device is made easy and in addition, the present invention involves a timing controller 300 to control the multiplexer modules 130 and the source driver 200 such that the source driver 200 writes the front-side and the back-side output data signals to the front-side OLED sub-pixel 121 and the back-side OLED sub-pixel 122 respectively and apply the reference voltage Vref to the electrowetting sub-pixel 123 to thereby effectively reduces the number of output terminals of the source driver 200, while using the timing controller 300 to control the voltage controller 400 for outputting the voltage value of the reference voltage Vref to the source driver 200 to realize controlling transparency or light-blocking of the electrowetting sub-pixel 123 for simultaneously fulfilling transparent displaying and dual-sided displaying.

In summary, the present invention provides a transparent dual-sided display device. The transparent dual-sided display device comprises a display panel comprising a plurality of sub-pixel groups that each include a front-side OLED sub-pixel, a back-side OLED sub-pixel, and an electrowetting sub-pixel and a plurality of multiplexer modules that each include three thin-film transistors and a timing controller is involved to control a multiplexer module and a source driver, wherein the source driver writes the front-side and back-side output data signals to the front-side OLED sub-pixel and the back-side OLED sub-pixel respectively and applies a reference voltage to the electrowetting sub-pixel, such that controlling can be, through the timing controller, a voltage controller to output a voltage value of the reference voltage to the source driver to control transparency or light-blocking of the electrowetting sub-pixel for simultaneously fulfilling transparent displaying and dual-sided displaying. The present invention provides a driving method of the transparent dual-sided display device, which allows for simultaneously fulfilling transparent displaying and dual-sided displaying.

Based on the description given above, those having ordinary skills in the art may easily contemplate various changes and modifications of the technical solution and the technical ideas of the present invention. All these changes and modifications are considered belonging to the protection scope of the present invention as defined in the appended claims.

What is claimed is:

1. A transparent dual-sided display device, comprising a display panel, a source driver electrically connected to the display panel, a timing controller electrically connected to both the source driver and the display panel, and a voltage controller electrically connected to both the timing controller and the source driver;

wherein the display panel comprises a transparent substrate, a plurality of sub-pixel groups arranged in an array on the transparent substrate, and a plurality of multiplexer modules respectively corresponding to a plurality columns of the sub-pixel groups; the source driver comprises a plurality of output terminals respectively corresponding to the plurality of rows of sub-pixel groups; each of the sub-pixel groups comprises a front-side organic light emitting display (OLED) sub-pixel and a back-side OLED sub-pixel that are respectively arranged on two opposite sides of the transparent substrate and an electrowetting sub-pixel arranged on one of the sides of the transparent substrate; each of the multiplexer modules comprises a first thin-film transistor, a second thin-film transistor, and a third thin-film transistor, the first thin-film transistor having a gate electrode input with a first control signal, a drain electrode electrically connected to all the front-side OLED sub-pixels of the sub-pixel groups of one of the columns corresponding thereto, and a source electrode electrically connected to one of the output terminals of the source driver corresponding thereto, the second thin-film transistor having a gate electrode input with a second control signal, a drain electrode electrically connected to all the back-side OLED sub-pixels of the sub-pixel groups of the one of the columns corresponding thereto, and a source electrode electrically connected to the one of the output terminals of the source driver corresponding thereto, the third thin-film transistor having a gate electrode input with a third control signal, a drain electrode electrically connected to all the electrowetting sub-pixel of the sub-pixel groups of the one of the columns corresponding thereto, and a source electrode electrically connected to the one of the output terminals of the source driver corresponding thereto;

wherein the voltage controller comprises a fourth thin-film transistor and a fifth thin-film transistor, the fourth thin-film transistor having a gate electrode input with a fourth control signal, a source electrode input with a second voltage, and a drain electrode electrically connected to a drain electrode of the fifth thin-film transistor and outputting a reference voltage to the source driver, the fifth thin-film transistor having a gate electrode input with a fifth control signal and a source electrode input with a first voltage; the first voltage is greater than the second voltage; each of the electrowetting sub-pixels is transparent upon application of the first voltage and blocks light upon application of the second voltage; and wherein the timing controller is operable to receive an input data signal and generating and supplying a front-side output data signal and a back-side output data signal to the source driver, outputting the first, second, and third control signals to control the first, second, and third thin-film transistors to conduct on or cut off, outputting the fourth and fifth control signals to control a voltage value of the reference voltage output from the voltage controller, and outputting a source driving control signal to the source driver to control the source driver to output the front-side output data signal, the back-side output data signal, or the reference voltage.

2. The transparent dual-sided display device according to claim 1, wherein the transparent dual-sided display device comprises a non-transparent dual-sided display mode and a transparent dual-sided display mode;

wherein when the transparent dual-sided display device is in the non-transparent dual-sided display mode, the timing controller outputs the fourth and fifth control signals to control the fourth thin-film transistor to conduct on and the fifth thin-film transistor cut off and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on; and when the transparent dual-sided display device is in the transparent dual-sided display mode, the timing controller outputs the fourth and fifth control signals to control the fourth thin-film transistor to cut off and the fifth thin-film transistor conducting on and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on.

3. The transparent dual-sided display device according to claim 2, wherein when the transparent dual-sided display device is in the non-transparent dual-sided display mode or the transparent dual-sided display mode, the timing controller reads parts of the input data signal that correspond to each of the columns of the sub-pixel groups in a forward sequence in order to acquire an intermediate front-side output data signal and reads parts of the input data signal that correspond to each of the columns of the sub-pixel groups in a reversed sequence in order to acquire an intermediate back-side output data signal and then, proceeds with frequency doubling of the intermediate front-side output data signal and the intermediate back-side output data signal to thereby obtain, and also feed, the front-side output data signal and the back-side output data signal to the source driver.

4. The transparent dual-sided display device according to claim 3, wherein the timing controller comprises a data handling unit, a frequency multiplication processing unit electrically connected to the data handling unit, and a control signal generator unit;

the data handling unit is operable for reading the parts of the input data signal that correspond to each of the columns of the sub-pixel groups in the forward sequence to acquire the intermediate front-side output data signal and reading the parts of the input data signal that correspond to each of the columns of the sub-pixel groups in the reversed sequence to acquire the intermediate back-side output data signal;

the frequency multiplication processing unit is operable to carry out a frequency doubling operation on the intermediate front-side output data signal and the intermediate back-side output data signal to obtain the front-side output data signal and the back-side output data signal, respectively; and the control signal generator unit is operable to generate the first, second, third, fourth, and fifth control signals and the source driving control signal.

5. The transparent dual-sided display device according to claim 1, wherein the second voltage is a common voltage; and the transparent dual-sided display device further comprises a voltage generator module electrically connected to the source driver and the voltage controller and the voltage generator module is operable to supply an operation voltage to the source driver and supplying the first voltage and the common voltage to the voltage controller.

6. A driving method of a transparent dual-sided display device, comprising the following steps:

Step S1: providing a transparent dual-sided display device according to claim 1;

Step S2: entering a non-transparent dual-sided display mode, wherein the timing controller is input with the input data signal and outputs the fourth and fifth control signals to control the fourth thin-film transistor to conduct on and the fifth thin-film transistor cut off, and meanwhile, the timing controller outputs the first, second, and third control signals to conduct on the third thin-film transistor, the first thin-film transistor, and the second thin-film transistor in order and outputs the front-side output data signal, the back-side output data signal, and the source driving control signal to the source driver to allow the source driver to apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on; and Step S3: entering a transparent dual-sided display mode, wherein the timing controller is input with the input data signal and outputs the fourth and fifth control signals to control the fourth thin-film transistor to cut off and the fifth thin-film transistor conducting one, and meanwhile, the timing controller outputs the first, second, and third control signals to conduct on the third thin-film transistor, the first thin-film transistor, the second thin-film transistor in order and outputs the front-side output data signal, the back-side output data signal, and the source driving control signal to the source driver to allow the source driver to apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on.

7. The driving method of the transparent dual-sided display device according to claim 6, wherein in Steps S2 and S3, the timing controller reads parts of the input data signal that correspond to each of the columns of the sub-pixel groups in a forward sequence in order to acquire intermediate front-side output data signal and reads parts of the input data signal that correspond to each of the columns of the sub-pixel groups in a reversed sequence in order to acquire intermediate back-side output data signal and then, proceeds with frequency doubling of the intermediate front-side output data signal and the intermediate back-side output data signal to thereby obtain, and also feed, the front-side output data signal and the back-side output data signal to the source driver.

8. The driving method of the transparent dual-sided display device according to claim 7, wherein the timing controller comprises a data handling unit, a frequency multiplication processing unit electrically connected to the data handling unit, and a control signal generator unit; and in Steps S2 and S3, the data handling unit reads the parts of the input data signal that correspond to each of the columns of the sub-pixel groups in the forward sequence to acquire the intermediate front-side output data signal and reading the parts of the input data signal that correspond each of the columns of the sub-pixel groups in the reversed sequence to acquire the intermediate back-side output data signal; the frequency multiplication processing unit carries out a frequency doubling operation on the intermediate front-side output data signal and the intermediate back-side output data signal to obtain the front-side output data signal and the back-side output data signal, respectively; the control signal generator unit generates the first, second, third, fourth, and fifth control signals and the source driving control signal.

9. The driving method of the transparent dual-sided display device according to claim 6, wherein the second voltage is a common voltage; and the transparent dual-sided display device further comprises a voltage generator module electrically connected to the source driver and the voltage controller and the voltage generator module is operable to supply an operation voltage to the source driver and supplying the first voltage and the common voltage to the voltage controller.

10. A transparent dual-sided display device, comprising a display panel, a source driver electrically connected to the display panel, a timing controller electrically connected to both the source driver and the display panel, and a voltage controller electrically connected to both the timing controller and the source driver;

wherein the display panel comprises a transparent substrate, a plurality of sub-pixel groups arranged in an array on the transparent substrate, and a plurality of multiplexer modules respectively corresponding to a plurality columns of the sub-pixel groups; the source driver comprises a plurality of output terminals respectively corresponding to the plurality of rows of sub-pixel groups; each of the sub-pixel groups comprises a front-side organic light emitting display (OLED) sub-pixel and a back-side OLED sub-pixel that are respectively arranged on two opposite sides of the transparent substrate and an electrowetting sub-pixel arranged on one of the sides of the transparent substrate; each of the multiplexer modules comprises a first thin-film transistor, a second thin-film transistor, and a third thin-film transistor, the first thin-film transistor having a gate electrode input with a first control signal, a drain electrode electrically connected to all the front-side OLED sub-pixels of the sub-pixel groups of one of the columns corresponding thereto, and a source electrode electrically connected to one of the output terminals of the source driver corresponding thereto, the second thin-film transistor having a gate electrode input with a second control signal, a drain electrode electrically connected to all the back-side OLED sub-pixels of the sub-pixel groups of the one of the columns corresponding thereto, and a source electrode electrically connected to the one of the output terminals of the source driver corresponding thereto, the third thin-film transistor having a gate electrode input with a third control signal, a drain electrode electrically connected to all the electrowetting sub-pixel of the sub-pixel groups of the one of the columns corresponding thereto, and a source electrode electrically connected to the one of the output terminals of the source driver corresponding thereto;

wherein the voltage controller comprises a fourth thin-film transistor and a fifth thin-film transistor, the fourth thin-film transistor having a gate electrode input with a fourth control signal, a source electrode input with a second voltage, and a drain electrode electrically connected to a drain electrode of the fifth thin-film transistor and outputting a reference voltage to the source driver, the fifth thin-film transistor having a gate electrode input with a fifth control signal and a source electrode input with a first voltage; the first voltage is greater than the second voltage; each of the electrowetting sub-pixels is transparent upon application of the first voltage and blocks light upon application of the second voltage;

wherein the timing controller is operable to receive an input data signal and generating and supplying a front-side output data signal and a back-side output data signal to the source driver, outputting the first, second, and third control signals to control the first, second, and third thin-film transistors to conduct on or cut off, outputting the fourth and fifth control signals to control a voltage value of the reference voltage output from the voltage controller, and outputting a source driving control signal to the source driver to control the source driver to output the front-side output data signal, the back-side output data signal, or the reference voltage;

wherein the transparent dual-sided display device comprises a non-transparent dual-sided display mode and a transparent dual-sided display mode;

wherein when the transparent dual-sided display device is in the non-transparent dual-sided display mode, the timing controller outputs the fourth and fifth control signals to control the fourth thin-film transistor to conduct on and the fifth thin-film transistor cut off and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on; and when the transparent dual-sided display device is in the transparent dual-sided display mode, the timing controller outputs the fourth and fifth control signals to control the fourth thin-film transistor to cut off and the fifth thin-film transistor conducting on and meanwhile, the timing controller outputs the first, second, and third control signals to conduct on the third thin-film transistor, the first thin-film transistor, and the second thin-film transistor in order and outputs the front-side output data signal, the back-side output data signal and the source driving control signal to the source driver to make the source driver apply the reference voltage to the electrowetting sub-pixel when the third thin-film transistor is conducting on, output the front-side output data signal to the front-side OLED sub-pixel when the first thin-film transistor is conducting on, and output the back-side output data signal to the back-side OLED sub-pixel when the second thin-film transistor is conducting on;

wherein when the transparent dual-sided display device is in the non-transparent dual-sided display mode or the transparent dual-sided display mode, the timing controller reads parts of the input data signal that correspond to each of the columns of the sub-pixel groups in a forward sequence in order to acquire an intermediate front-side output data signal and reads parts of the input data signal that correspond to each of the columns of the sub-pixel groups in a reversed sequence in order to acquire an intermediate back-side output data signal and then, proceeds with frequency doubling of the intermediate front-side output data signal and the intermediate back-side output data signal to thereby obtain, and also feed, the front-side output data signal and the back-side output data signal to the source driver;

wherein the second voltage is a common voltage; and the transparent dual-sided display device further comprises a voltage generator module electrically connected to the source driver and the voltage controller and the voltage generator module is operable to supply an operation voltage to the source driver and supplying the first voltage and the common voltage to the voltage controller; and wherein the timing controller comprises a data handling unit, a frequency multiplication processing unit electrically connected to the data handling unit, and a control signal generator unit;

the data handling unit is operable for reading the parts of the input data signal that correspond to each of the columns of the sub-pixel groups in the forward sequence to acquire the intermediate front-side output data signal and reading the parts of the input data signal that correspond to each of the columns of the sub-pixel groups in the reversed sequence to acquire the intermediate back-side output data signal;

the frequency multiplication processing unit is operable to carry out a frequency doubling operation on the intermediate front-side output data signal and the intermediate back-side output data signal to obtain the front-side output data signal and the back-side output data signal, respectively; and the control signal generator unit is operable to generate the first, second, third, fourth, and fifth control signals and the source driving control signal.

* * * * *